US008997374B2

(12) United States Patent
Sato

(10) Patent No.: US 8,997,374 B2
(45) Date of Patent: Apr. 7, 2015

(54) DRYING FURNACE AND DRYING METHOD

(75) Inventor: Wataru Sato, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 234 days.

(21) Appl. No.: 13/699,520

(22) PCT Filed: May 24, 2011

(86) PCT No.: PCT/JP2011/061911

§ 371 (c)(1),
(2), (4) Date: Nov. 21, 2012

(87) PCT Pub. No.: WO2011/148955

PCT Pub. Date: Dec. 1, 2011

(65) Prior Publication Data

US 2013/0061489 A1 Mar. 14, 2013

(30) Foreign Application Priority Data

May 26, 2010 (JP) ..... 2010-120620

(51) Int. Cl.

| | |
|---|---|
| ***F26B 3/28*** | (2006.01) |
| ***F26B 15/16*** | (2006.01) |
| ***F26B 3/30*** | (2006.01) |
| *B05D 3/02* | (2006.01) |

(52) U.S. Cl.

CPC ..... *F26B 3/283* (2013.01); *B05D 3/0263* (2013.01); *B05D 3/0272* (2013.01); *F26B 15/16* (2013.01); *F26B 2210/12* (2013.01); *F26B 3/30* (2013.01)

(58) Field of Classification Search

USPC ..... 34/266, 268, 270, 381, 413, 427, 442, 34/524, 90, 103, 666; 427/195, 316, 475; 219/388, 411; 432/9, 19, 37, 229; 118/642; 165/61

See application file for complete search history.

(56) References Cited

U.S. PATENT DOCUMENTS

| | | | | | |
|---|---|---|---|---|---|
| 2,761,948 | A | * | 9/1956 | Todd | 392/415 |
| 4,546,553 | A | * | 10/1985 | Best | 34/266 |
| 4,600,491 | A | * | 7/1986 | Urquhart et al. | 34/68 |
| 4,635,381 | A | * | 1/1987 | Hubbert | 34/571 |
| 4,656,758 | A | * | 4/1987 | Nakayama | 34/565 |
| 4,761,894 | A | * | 8/1988 | Hamasaki et al. | 34/270 |
| 5,060,594 | A | | 10/1991 | Tomioka et al. | |
| 5,070,625 | A | * | 12/1991 | Urquhart | 34/268 |
| 5,144,754 | A | * | 9/1992 | Persson | 34/491 |
| 5,282,145 | A | * | 1/1994 | Lipson et al. | 700/208 |
| 5,456,023 | A | * | 10/1995 | Farnan | 34/270 |
| 5,594,999 | A | * | 1/1997 | Best | 34/270 |

(Continued)

FOREIGN PATENT DOCUMENTS

| | | |
|---|---|---|
| CN | 1829888 | 9/2006 |
| JP | 58-192395 U | 12/1983 |

(Continued)

OTHER PUBLICATIONS

Chinese Office Action dated May 22, 2014, 7 pages.

*Primary Examiner* — Steve M Gravini
(74) *Attorney, Agent, or Firm* — Rankin, Hill & Clark LLP

(57) ABSTRACT

A drying furnace (20) for drying an object (11) by hot air is provided with a heater (36, 38, 43, 45) that applies radiant heat to a hard-heating region (35, 42) having a larger heat capacity than the other region (37, 44) in the object (11) so as to heat the hard-heating region (35, 42) to a temperature approximate to a temperature of the other region (37, 44).

5 Claims, 10 Drawing Sheets

(56) References Cited

U.S. PATENT DOCUMENTS

| | | | | |
|---|---|---|---|---|
| 5,661,912 | A * | 9/1997 | Bhatnagar et al. | 34/270 |
| 5,689,899 | A * | 11/1997 | Szenker et al. | 34/270 |
| 6,394,796 | B1 * | 5/2002 | Smith | 432/229 |
| 6,895,689 | B2 * | 5/2005 | Ueno | 34/270 |
| 6,921,558 | B2 * | 7/2005 | Fredericksen et al. | 427/475 |
| 6,968,633 | B2 * | 11/2005 | Morrison | 34/666 |
| 2004/0231183 | A1 * | 11/2004 | Makoto | 34/270 |
| 2007/0235437 | A1 | 10/2007 | Klobucar et al. | |
| 2007/0272150 | A1 | 11/2007 | Swoboda et al. | |
| 2010/0088921 | A1 * | 4/2010 | Bergaglio | 34/270 |
| 2011/0132572 | A1 * | 6/2011 | Sato | 165/61 |
| 2013/0061489 | A1 * | 3/2013 | Sato | 34/267 |

FOREIGN PATENT DOCUMENTS

| | | | |
|---|---|---|---|
| JP | 3/135474 | A | 6/1991 |
| JP | 07-103650 | | 4/1995 |
| JP | 10-225657 | A | 8/1998 |
| JP | 2000-197845 | A | 7/2000 |
| JP | 2004-275888 | A | 10/2004 |
| WO | 93/05353 | | 3/1993 |

* cited by examiner 11
12
13
14
15
(1)
ROOM TEMPERATURE
HOT AIR
LOCAL HEATING

DRYING FURNACE AND DRYING METHOD

CROSS-REFERENCED TO RELATED APPLICATION

This application is a National Phase entry of International Application PCT/JP2011/061911, filed May 24, 2011, which claims priority to Japanese Patent Application No. 2010-120620, filed May 26, 2010, the disclosure of the prior applications are hereby incorporated in their entirety by reference.

TECHNICAL FIELD

The present invention relates to a drying technique for drying an object by hot air.

BACKGROUND ART

As an example of a drying furnace, there is a hot air circulation drying furnace. In this drying furnace, an object is dried by hot air which is circulating. The object is often a combination of a plurality of members and includes thick portions and thin portions. The thick portions have a large heat capacity and thus are regions (hereinafter, referred to as "hard-heating regions") which are difficult to be warm. On the contrary, the thin portions have a small heat capacity and thus are regions (hereinafter, referred to as "easy-heating regions") which are easy to be warm. When the object is dried by the hot air circulation drying furnace, a drying operation is continuously carried out until the hard-heating regions are completely dried, despite the fact that the easy-heating regions have been completely dried. Consequently, drying time becomes longer. For this reason, a technology to improve a speed of temperature rising of the hard-heating regions is demanded.

Conventionally, as a technology to improve the speed of temperature rising of the hard-heating regions of the object, drying techniques for locally heating the object have been variously suggested, in addition to a heating by hot air (see Patent Document 1 (FIG. 4), for example).

Patent Document 1 is described with reference to FIG. 11.

As shown in FIG. 11, a drying furnace 100 includes a furnace body 102, a pair of hot air inlets 105, 106, a pair of hot air ejecting ports 109, 111, a pair of hot air suction ports 114, 115 and a pair of hot air outlets 116, 117. The furnace body 102 is formed to surround an object 101. The hot air inlets 105, 106 are respectively provided at a lower portion of a left side wall 103 and a lower portion of a right side wall 104 of the furnace body 102 to introduce hot air therethrough. The hot air ejecting ports 109, 111 are respectively provided at lower headers 107, 108 connected to the hot air inlets 105, 106 to eject the introduced hot air into the furnace body 102. The hot air suction ports 114, 115 are respectively provided at upper headers 112, 113 to suck the hot air in the furnace body 102. The upper headers 112, 113 are respectively provided at an upper inner side of the left side wall 103 and an upper inner side of the right side wall 104. The hot air outlets 116, 117 are respectively connected to the upper headers 112, 113 to exhaust the hot air out of the furnace body 102.

A blower is connected to the hot air outlets 116, 117. A heating device is connected to a discharge side of the blower and the hot air inlets 105, 106 are connected to the heating device. In addition, a pair of left and right heaters 118, 119 is disposed near the bottom of the object 101. These heaters 118, 119 are connected to the blower and the heating device.

In the drying furnace 100, the hot air ejected from the hot air ejecting ports 109, 111 is brought into contact with the object 101 and thus the object 101 is dried. The hot air flows out of the furnace body 102 through the hot air suction ports 114, 115 from the interior of the furnace body 102. The hot air is heated and ejected again from the hot air ejecting ports 109, 111 through the hot air inlets 105, 106. That is, the object 101 is dried by the hot air which is circulating.

Further, if a bottom 121 of the object 101 is thick, the bottom 121 has a large heat capacity and thus is the hard-heating region. Ejection nozzles 122 of the heaters 118, 119 eject the hot air toward the bottom 121 of the object 101. As the hot air is ejected in this way, it is possible to improve the temperature rising speed for the bottom 121 of the object 101.

However, since the hot air ejected from the ejection nozzles 122 of the heaters 118, 119 is spread around the bottom 121 of the object 101 in the drying furnace 100, it is difficult to give a target amount of heat to target regions. If a drying time becomes longer as a measure, the temperature of the bottom 121 which is the hard-heating region is increased, but the easy-heating region of the object 101 is subjected to excessive heat, despite the fact that the temperature of the easy-heating region is already increased. This is undesirable from the viewpoint of energy saving.

PRIOR ART DOCUMENT

Patent Document

Patent Document 1: JP-A-2000-197845

SUMMARY OF INVENTION

Embodiments of the present invention provide a drying technique capable of reducing unnecessary amount of heat which was given to easy-heating regions of an object.

According to embodiments of the present invention, a drying furnace 20 for drying an object 11 by hot air may include a heater 36, 38, 43, 45 that applies radiant heat to a hard-heating region 35, 42 having a larger heat capacity than the other region 37, 44 in the object 11 so as to heat the hard-heating region 35, 42 to a temperature approximate to a temperature of the other region 37, 44.

In addition, according to embodiments of the present invention, a drying method for drying an object 11 by hot air using a drying furnace 20 may include: a temperature increasing process of increasing a temperature of the object 11; a temperature measuring process of measuring a temperature of a hard-heating region 35, 42 having a larger heat capacity than the other region 37, 44 in the object 11 by a first temperature measuring part 73, 77 and measuring a temperature of the other region 37, 44 by a second temperature measuring part 75, 79; a local heating process of locally heating the hard-heating region 35, 42 to a temperature approximate to the temperature of the other region 37, 44 by applying radiant heat to the hard-heating region 35, 42 of the object 11; and a temperature maintaining process of constantly maintaining the temperature of the object 11.

Other aspects and advantages will be apparent from the following description and the appended claims.

DESCRIPTION OF EMBODIMENTS

Figures 1A, 1B, 1C, 1D:
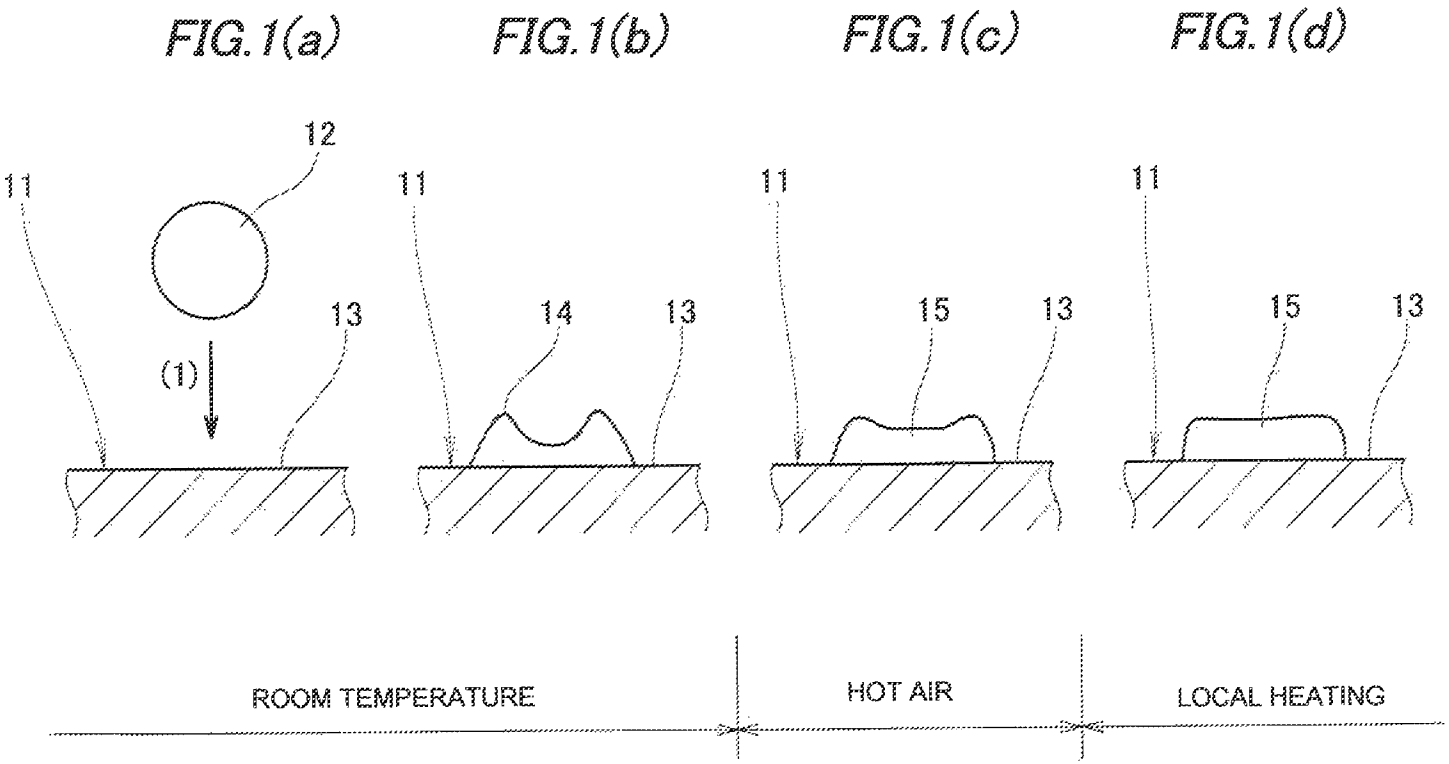
FIGS. 1(*a*) to 1(*d*) are views for explaining a drying mechanism which dries paint on a surface of an object, according to an exemplary embodiment.

According to embodiments of the present invention, a drying furnace includes a heater which applies radiant heat to a hard-heating region of an object that has a larger heat capacity than the other regions and thus heats the hard-heating region to a temperature approximate to that of the other regions. Here, the other regions may be easy-heating regions. The drying furnace is configured so that the hard-heating region of the object is locally heated by the heater in a state where the object is entirely heated by the hot air. Since the radiant heat applied by the heater is absorbed by the object in the form of electromagnetic waves, the hard-heating region of the object can be reliably heated. With such a heating, a temperature of the hard-heating region of the object is increased and therefore it is possible to reliably heat the hard-heating region of the object to a temperature approximate to that of the easy-heating regions thereof.

According to a case in which the hard-heating region of the object is locally heated by the hot air ejected from an ejection nozzle in a state where the object is entirely heated by the hot air, the ejected hot air is spread around the hard-heating region. With such a spread of the hot air, it is difficult to allow the hot air to evenly reach the hard-heating region of the object and therefore it is difficult to increase the temperature of the hard-heating region. Heating may be continuously performed in order to increase the temperature of the hard-heating region. However, in this case, the easy-heating regions which have been already heated are subjected to excessive heat.

In contrast, according to the embodiments of the invention, the drying furnace can reliably heat the hard-heating region of the object to a temperature approximate to that of the easy-heating regions thereof by applying the radiant heat to the hard-heating regions. That is, since the temperature of the hard-heating region and the easy-heating regions of the object can be substantially equally increased, there is no case that the easy-heating regions are subjected to the excessive heat. Accordingly, it is possible to provide a drying furnace capable of reducing unnecessary amount of heat which was given to the easy-heating regions of the object.

The heater may be a near-infrared lamp. As an infrared ray, a near-infrared ray and a far-infrared ray whose wavelength is longer than the near-infrared ray are known. Further, it is known that absorption rate (energy absorption rate) is different, depending on the type of target to be irradiated. If the object is a vehicle body, the object is defined by an iron-based material constituting the vehicle body and a coating film which is formed by applying paint such as acrylic water-based paint to the vehicle body. The following Table 1 shows the absorption rate of the iron and the acrylic water-based paint.

TABLE 1

| Ray Type | Wavelength | Acrylic water-based paint | Iron |
|---|---|---|---|
| Near-infrared ray | 0.78~3 μm | Not more than 10% | 35% |
| Far-infrared ray | Beyond 3 μm | 74% | Not more than 10% |

When it is intended to mainly heat the coating film, the far-infrared ray having absorption rate of approximately 74% relative to the acrylic water-based paint would be suitable. However, the far-infrared ray does not give an effect to the coating film which is applied to an inner surface of the vehicle body. For this reason, in embodiments of the invention, the near-infrared ray having absorption rate of approximately 35% relative to iron is used to mainly heat the iron, that is, the vehicle body, and the coating film on the inner surface is dried by the heat from the vehicle body. By using the near-infrared ray, even the temperature of the regions of the object which are not directly irradiated by the near-infrared ray can be increased using the heat conduction of the member without time-consumption.

The drying furnace may include a first temperature measuring part for measuring the temperature of the hard-heating region and a second temperature measuring part for measuring the temperature of the other regions, on an upstream side of the heater. Further, the drying furnace may include a control part for controlling a power of the heater based on temperature information from the first temperature measuring part and the second temperature measuring part. When the temperature of the hard-heating region measured by the first temperature measuring part is largely different from the temperature of the other regions measured by the second temperature measuring part, a high-power command is sent to the heater from the control part. On the contrary, when the temperature of the hard-heating region measured by the first temperature measuring part is only slightly different from the temperature of the other regions measured by the second temperature measuring part, a low-power command is sent to the heater from the control part. By comparing the temperature of the hard-heating region of the object with the temperature of the other regions in this way, the control part controls the heater to output a suitable amount of heat in accordance with the temperature difference. Accordingly, the heater can apply the suitable amount of heat to the hard-heating regions of the object.

Further, according to embodiments of the present invention, a drying method is carried out using a drying furnace which dries an object by hot air. The drying method may include a temperature increasing process of increasing a temperature of the object, a temperature measuring process of measuring a temperature of a hard-heating region of the object which have a larger heat capacity than the other regions by a first temperature measuring part and measuring a temperature of the other regions by a second temperature measuring part, a local heating process of locally heating the hard-heating region to a temperature approximate to that of the other regions by applying radiant heat to the hard-heating region of the object and a temperature maintaining process of constantly maintaining the temperature of the object. Here, the other regions may be easy-heating regions.

Since the radiant heat used in the local heating step is absorbed by the object in the form of electromagnetic waves, the hard-heating region of the object can be reliably heated. With such a heating, the temperature of the hard-heating region of the object is increased and therefore it is possible to reliably heat the hard-heating region of the object to a temperature approximate to that of the easy-heating regions thereof.

In a case where the hard-heating region of the object is locally heated by the hot air ejected from the ejection nozzle in a state where the object is entirely heated by the hot air, the ejected hot air is spread around the hard-heating region. With such a spread of the hot air, it is difficult to allow the hot air to evenly reach the hard-heating region of the object and therefore it is difficult to increase the temperature of the hard-heating region. Heating may be continuously performed in order to increase the temperature of the hard-heating region. As a result, the easy-heating regions which have been already heated are subjected to excessive heat.

In contrast, according to embodiments of the invention, the drying method can reliably heat the hard-heating region of the object to a temperature approximate to that of the easy-heating regions thereof by applying the radiant heat to the hard-heating region in the local heating step. That is, since the temperature of the hard-heating region and the easy-heating regions of the object can be substantially equally increased, there is no case that the easy-heating regions are subjected to the excessive heat. Accordingly, it is possible to provide a drying method capable of reducing unnecessary amount of heat which was given to the easy-heating regions of the object.

The object may be subjected to a painting operation before being introduced into the drying furnace. Further, a timing for applying the radiant heat to the hard-heating regions of the object in the local heating step may be the timing when the temperature of the hard-heating region measured by the first temperature measuring part reaches a cross-linking temperature of the paint applied onto the object. Hereinafter, a drying mechanism for drying the paint on a surface of the object is described.

When atomized paint is sprayed onto the object, paint particles are directed to a surface of the object. At this time, a surface temperature of the object is at room temperature.

As the paint particles collide with the surface of the object, the paint adhered to the surface of the object is caused to be swollen. Simultaneously, volatile components of the paint are evaporated and therefore the paint is hardened in a state of being swollen.

Next, as the painted object is put into the drying furnace, the paint which has been hardened on the surface of the object is heated by hot air. The heated paint is fluidized. Further, surface tension and gravity act on the paint in an amplitude direction of the swelling. And then, a smooth coating film is formed.

At timing when the temperature of the object is further increased and thus the surface temperature thereof reaches the cross-linking temperature of the paint, the radiant heat is applied to the surface of the object. Since the cross-linking has been already started at this timing, the paint does not flow and thus the smooth coating film formed as mentioned above can be maintained. Consequently, it is possible to realize the smooth coating film.

In a case the painted object is put into the drying furnace and the radiant heat is applied to the hard-heating region of the object at a start of the hot air drying, the paint applied on the object is fluidized. However, since the object is locally heated by the radiant heat and thus a temperature rising speed of the object becomes larger, the paint in an insufficient flowing state becomes hot and thus the paint is hardened. Accordingly, the coating film is difficult to be smooth and thus the quality of the coating film is degraded.

In contrast, according to embodiments of the invention, the drying method applies the radiant heat to the hard-heating regions of the object at timing when the temperature of the hard-heating regions of the object reaches the cross-linking temperature of the paint applied onto the object. That is, the hard-heating region of the object is subjected to the local heating by the radiant heat when a predetermined time has elapsed from the start of the hot air drying. During the start of the hot air drying to the start of the local heating, the paint applied onto the hard-heating regions is fluidized. At the start of the hot air drying, the temperature rising speed of the object is small. Therefore, after the paint is sufficiently flowing, the paint becomes hot and then is hardened. As a result, the smooth coating film can be achieved and thus the quality of the coating film is improved.

Heat source of the radiant heat may be a near-infrared ray. In this case, as shown in the above-described Table 1, the near-infrared ray having absorption rate of approximately 35% relative to iron is used to mainly heat the iron, that is, the vehicle body and the coating film on the inner surface is dried by the heat from the vehicle body. As a result, by using the near-infrared ray, even the temperature of the region of the object which is not directly irradiated by the near-infrared ray can be increased using the heat conduction of the member without time-consumption.

Embodiment

Hereinafter, embodiments of the present invention will be described with reference to the accompanying drawings. The drawings are viewed in directions of symbols. In the present embodiment, an object to be dried is a vehicle body. A side sill is represented as an example of the hard-heating region which has a larger heat capacity than the other regions and a door outer panel is represented as an example of the other region. Further, in the present embodiment, the vehicle body put into the drying furnace has been subjected to a painting operation by painting equipment which is provided at an upstream side of the drying furnace.

As shown in FIG. 1 (*a*), when atomized paint is sprayed on a vehicle body 11 (which will be described in detail below), paint particles 12 are directed to a surface 13 of the vehicle body 11 as indicated by arrow (1). At this time, a surface temperature of the vehicle body 11 is at room temperature.

As the paint particles 12 collide with the surface 13 of the vehicle body 11, the paint 14 adhered to the surface 13 of the vehicle body 11 is caused to be swollen, as shown in FIG. 1 (*b*). Simultaneously, volatile components of the paint 14 are evaporated and therefore the paint 14 is hardened in a state of being swollen.

Next, as the painted vehicle body 11 is put into a drying furnace (which will be described in detail below), the paint 14 which has been hardened on the surface 13 of the vehicle body 11 is heated by hot air. The heated paint 14 is fluidized. Further, surface tension and gravity act on the paint 14 in an amplitude direction of the swelling. And then, a smooth coating film 15 is formed, as shown in FIG. 1 (*c*).

At a time when the temperature of the vehicle body 11 is further increased and thus the surface temperature of the vehicle body 11 reaches a cross-linking temperature of the paint, radiant heat emitted from a heater (which will be described in detail below) is applied to the surface 13 of the vehicle body 11. Since the cross-linking has been already started at this timing, the paint does not flow and thus the smooth coating film 15 formed in FIG. 1 (*c*) can be maintained. Consequently, it is possible to realize the smooth coating film 15, as shown in FIG. 1 (*d*).

Figure 2A:
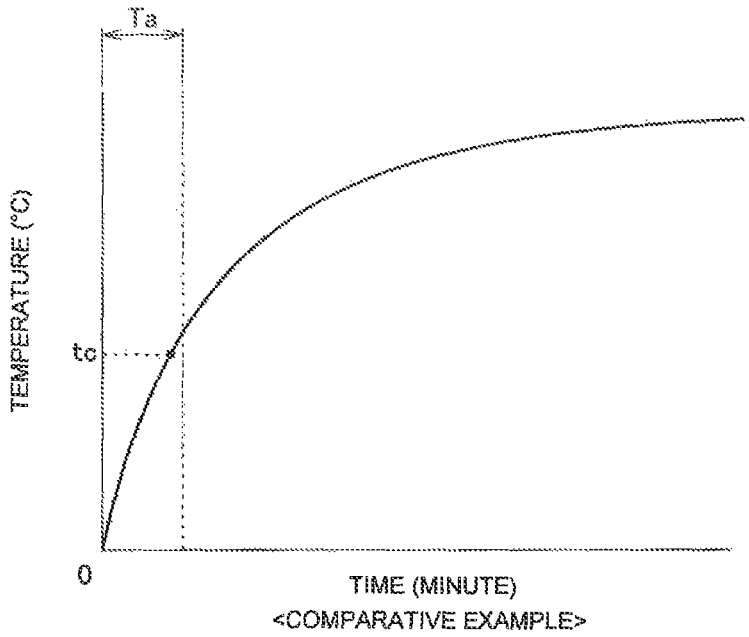
FIGS. 2(*a*) and 2(*b*) are graphs for explaining a local heating start time in a comparative example and an example.
Figure 2B:
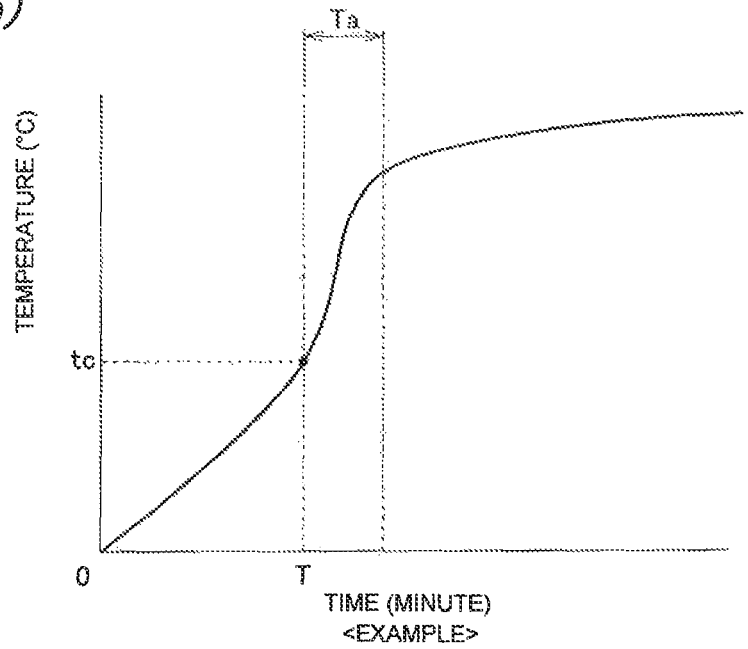

Next, the timing of the start of local heating will be described. FIG. 2 (*a*) illustrates a comparative example and FIG. 2 (*b*) illustrates an example. As shown in FIG. 2 (*a*), at the start of hot air drying, a side sill (which will be described in detail below) of the vehicle body is subjected to the local heating (which will be described in detail below) by the radiant heat in addition to the hot air for a certain period of time Ta. As a result, a temperature rise curve is obtained. In this curve, the temperature rising speed at the start of heating is increased. Further, during local heating time Ta, the surface temperature of the vehicle body reaches a temperature "tc". The temperature "tc" is equal to the cross-linking temperature of the paint.

If the local heating for the side sill of the vehicle body is started at the start of the hot air drying, the paint applied on the side sill is fluidized. However, since the temperature rising speed of the vehicle body is increased by the local heating, the paint in an insufficient flowing state becomes hot and thus the paint is hardened. Accordingly, the coating film is difficult to be smooth and thus the quality of the coating film is degraded.

As shown in FIG. 2 (*b*), when the time T has elapsed from the start of the hot air drying, the side sill of the vehicle body is subjected to the local heating by the radiant heat in addition to the hot air for a certain period of time Ta. As a result, temperature rise curve is obtained. In this curve, the temperature rising speed at the start of heating is decreased as compared to FIG. 2 (*a*). Further, in FIG. 2 (*b*), the surface temperature of the vehicle body reaches a temperature "tc" at the local heating start time T. The temperature "tc" is equal to the cross-linking temperature of the paint.

The side sill of the vehicle body is subjected to the local heating when a predetermined time T has elapsed from the start of the hot air drying. During the start of the hot air drying to the start of the local heating, the paint applied onto the side sill is fluidized. At the start of the hot air drying, the temperature rising speed of the vehicle body is small. Therefore, after the paint is sufficiently flowing, the paint becomes hot and then is hardened. As a result, the smooth coating film can be achieved and thus the quality of the coating film is improved.

Figure 3A:
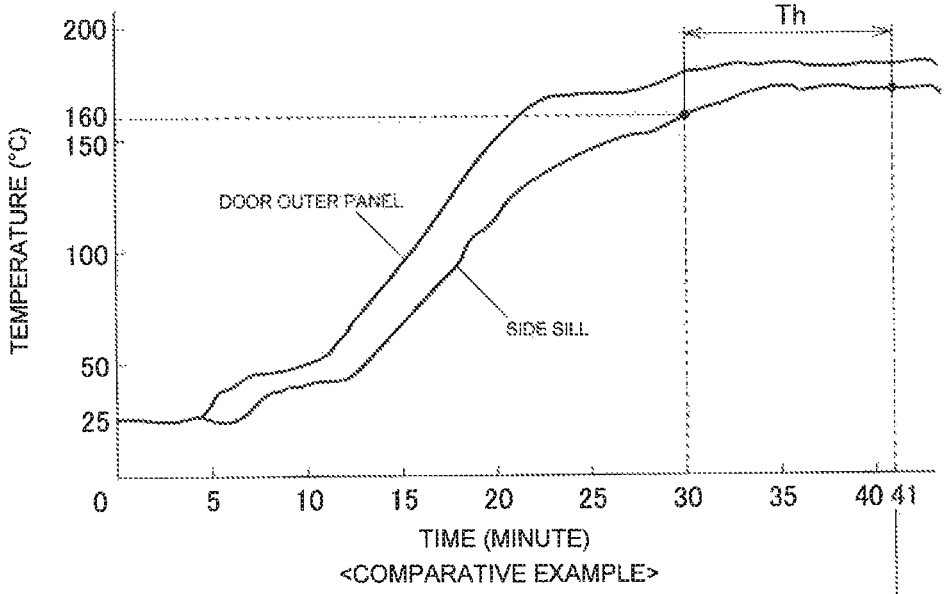
FIGS. 3(*a*) and 3(*b*) are graphs for explaining a temperature rising speed in the comparative example and the example.
Figure 3B:
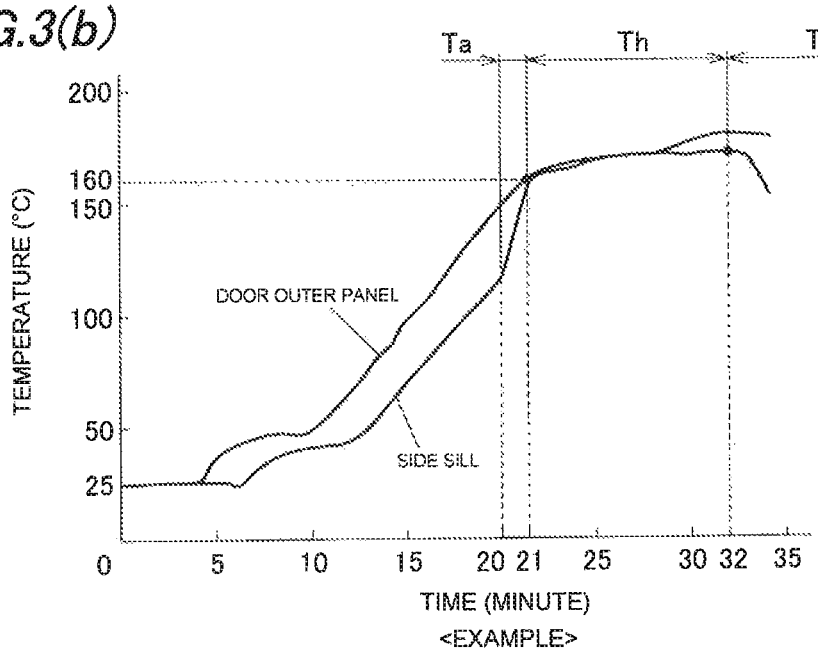

Next, relationship between the local heating and the drying time is described. FIG. 3 (*a*) illustrates a comparative example and FIG. 3 (*b*) illustrates an example. When the painted vehicle body is dried by being put into the drying furnace in which the hot air is circulating, it takes a total of forty-one minutes, for example, until the target surface temperature (160° C.) of the vehicle body is maintained for a target time Th (=eleven minutes), as shown in FIG. 3 (*a*).

Meanwhile, in a state where the painted vehicle body is dried by the hot air in the drying furnace, the side sill of the vehicle body is subjected to the local heating by the radiant heat emitted from the heater for a certain period of time Ta (=one minute) when twenty minutes have elapses from the start of the hot air drying, as shown in FIG. 3 (*b*).

Since the temperature rising speed of the side sill is increased by the local heating, the temperature rise curve of the side sill is approximated to the temperature rise curve of a door outer panel (which will be described in detail below) of the vehicle body. As a result, it takes a total of thirty-two minutes, for example, until the target surface temperature (160□) of the side sill is maintained for a target time Th (=eleven minutes). As is apparent from comparison between FIG. 3 (*a*) and FIG. 3 (*b*), it is possible to reduce the time of Td (=nine minutes) as compared to FIG. 3 (*a*) when the temperature rising speed of FIG. 3 (*b*) is used. The drying furnace which carries out the drying of the vehicle body is described with reference to FIG. 4.

Figure 4:
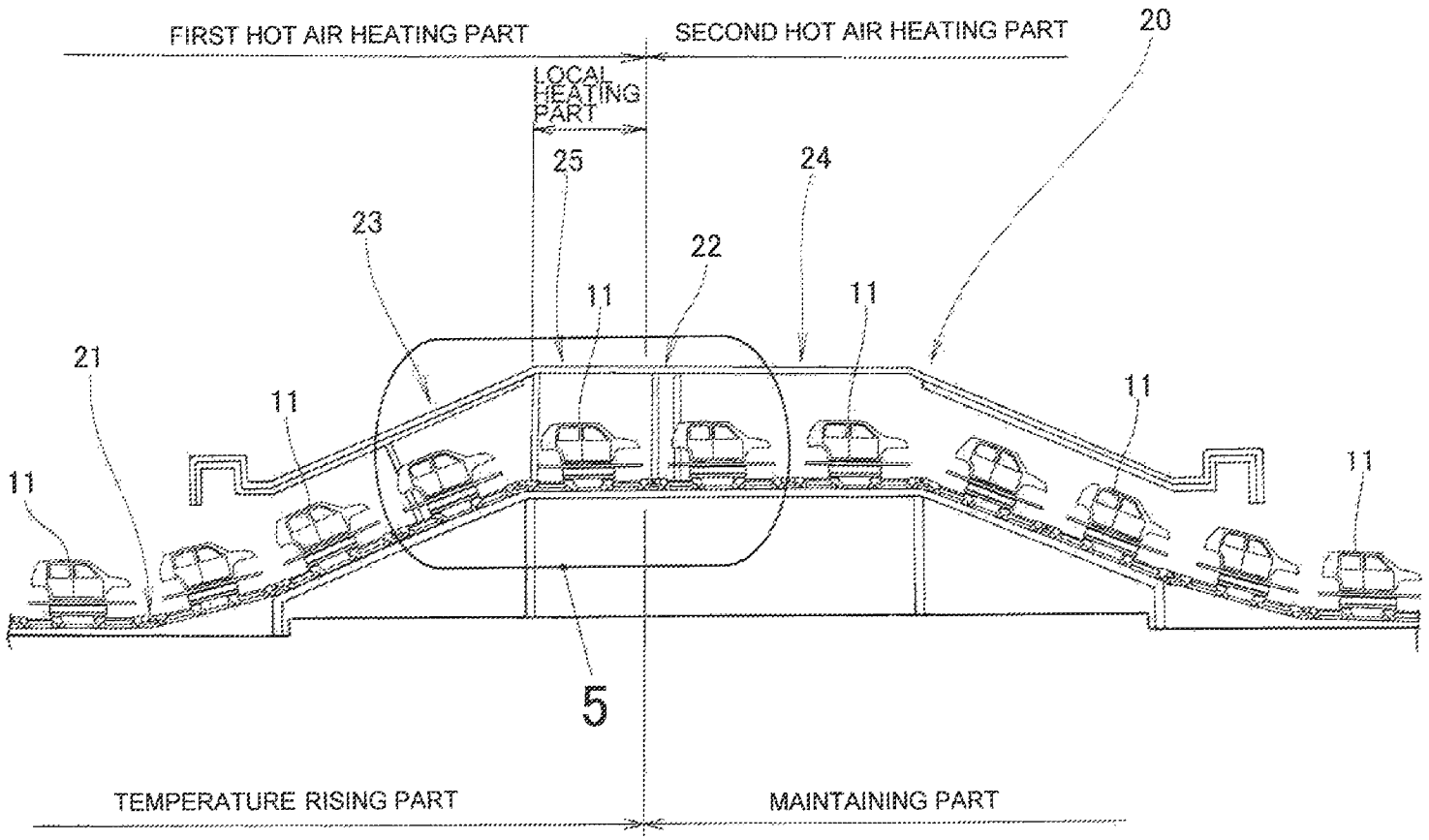
FIG. 4 is a cross-sectional view of a drying furnace.

As shown in FIG. 4, a drying furnace 20 includes a furnace body 22 to surround a plurality of vehicle bodies 11 which are conveyed by a conveyor 21. In the furnace body 22, paint applied onto the vehicle body 11 is dried by hot air. After the hot air is introduced into the furnace body 22, the hot air is brought into contact with the vehicle body 11 and then exhausted out of the furnace body 22. And again, the hot air exhausted from the furnace body 22 is heated and introduced into the furnace body 22. That is, the drying furnace 20 is a hot air circulation drying furnace.

The drying furnace 20 includes a first hot air heating part 23 arranged on an upstream side and a second hot air heating part 24 arranged on a downstream side. The first hot air heating part 23 corresponds to a temperature rising part to increase the temperature of the vehicle body 11. Further, the second hot air heating part 24 corresponds to a temperature maintaining part to maintain the increased temperature of the vehicle body 11.

In addition, a local heating part (25; which will be described in detail below) is provided at a termination of the first hot air heating part 23. Next, a configuration of the local heating part 25 is described.

Figure 5:
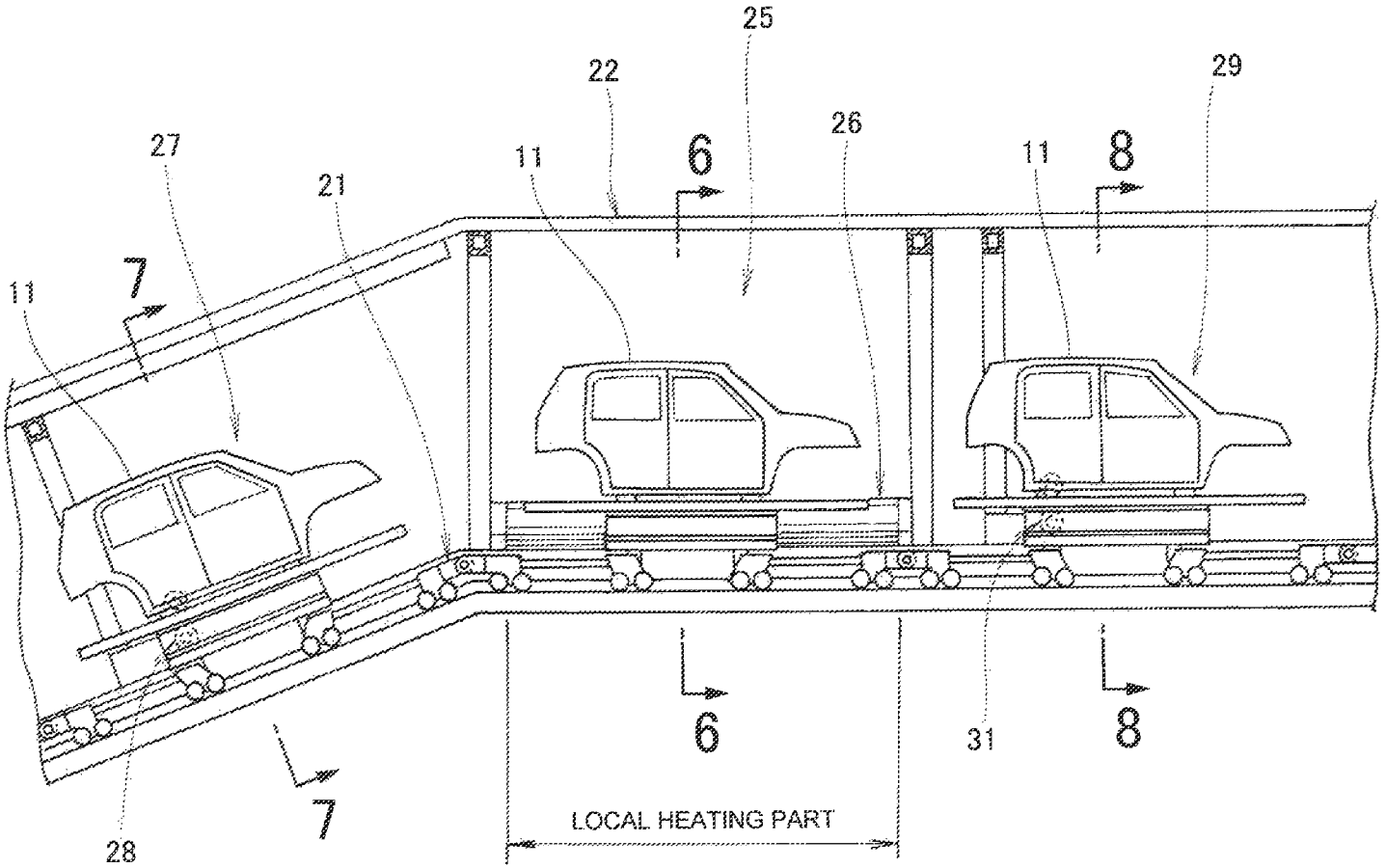
FIG. 5 is an enlarged view of "5" section of FIG. 4.

As shown in FIG. 5, a local heating device (26; which will be described in detail below) for locally heating the vehicle body 11 is provided in the local heating part 25. An upstream temperature measuring part 27 is provided at an upstream side of the local heating part 25. An upstream temperature measuring device (28; which will be described in detail below) for measuring the temperature of each part of the vehicle body 11 is provided in the upstream temperature measuring part 27. Further, a downstream temperature measuring part 29 is provided at a downstream side of the local heating part 25. A downstream temperature measuring device (31; which will be described in detail below) for measuring the temperature of each part of the vehicle body 11 is provided in the downstream temperature measuring part 29. Next, a detailed configuration of the local heating device 26 is described with reference to FIG. 6.

Figure 6:
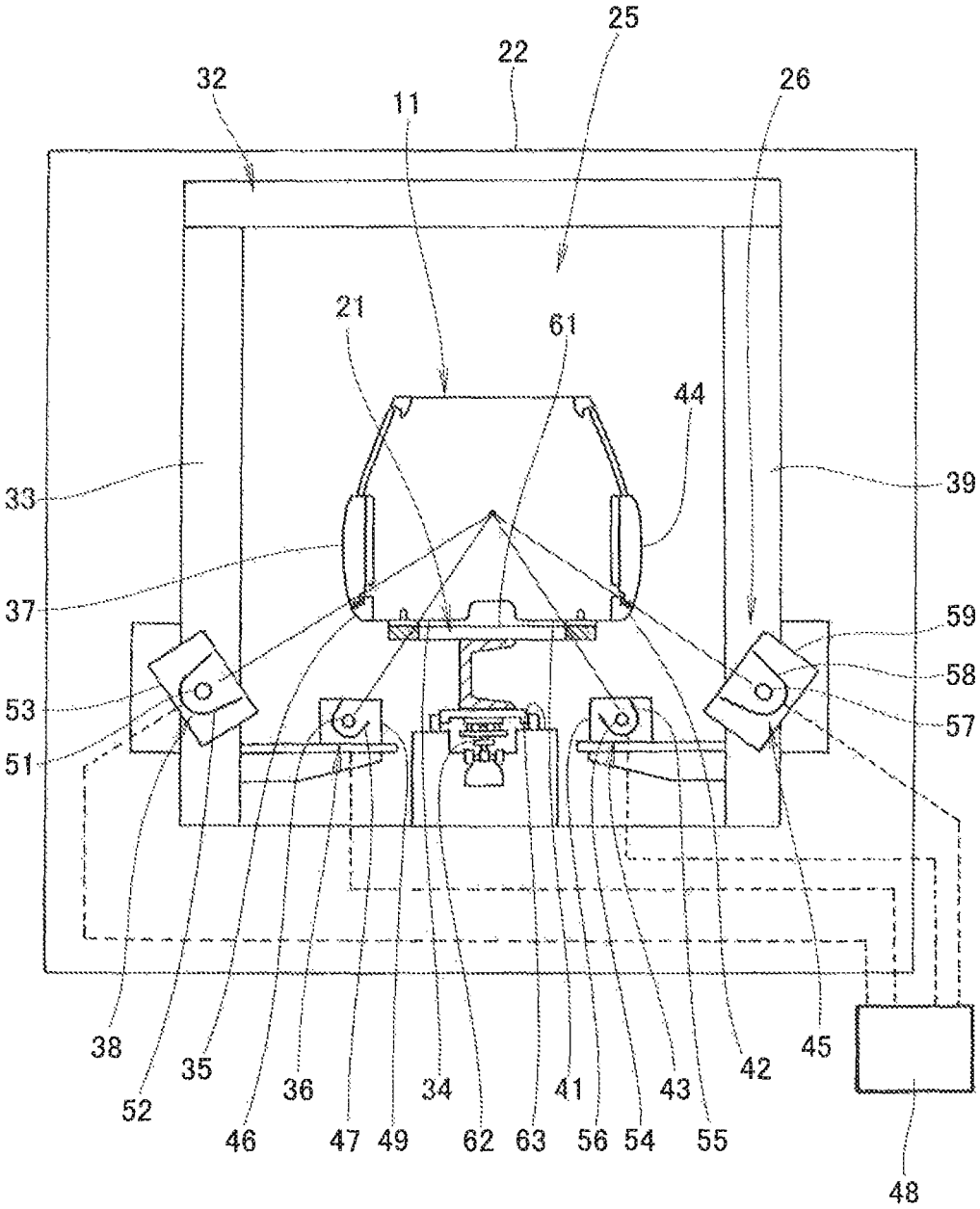
FIG. 6 is a cross-sectional view taken along line 6-6 of FIG. 5.

As shown in FIG. 6, the local heating device 26 is supported on a portal frame 32 which is erected in the furnace body 22. Further, the local heating device 26 includes a left inner heater 36, a left outer heater 38, a right inner heater 43 and a right outer heater 45. The left inner heater 36 and the left outer heater 38 are provided on a left column 33 of the portal frame 32. The right inner heater 43 and the right outer heater 45 are provided on a right column 39 of the portal frame 32. The left inner heater 36 applies radiant heat to a left bottom 34 and a left side sill 35 of the vehicle body 11 which are hard-heating regions and thus heats them. The left outer heater 38 applies the radiant heat to the left side sill 35 of the vehicle body 11 which is the hard-heating region having a larger heat capacity than a left door outer panel 37 and thus heats the left side sill 35 to a temperature approximate to that of the left door outer panel 37. The right inner heater 43 applies the radiant heat to a right bottom 41 and a right side sill 42 of the vehicle body 11 which are hard-heating regions and thus heats them. The right outer heater 45 applies the radiant heat to the right side sill 42 of the vehicle body 11 which is the hard-heating region having a larger heat capacity than a right door outer panel 44 and thus heats the right side sill 42 to a temperature approximate to that of the right door outer panel 44.

The left inner heater 36, the left outer heater 38, the right inner heater 43 and the right outer heater 45 are respectively a near-infrared lamp. The left inner heater 36 is provided with a left inner side reflection plate 47 to surround a left inner side filament 46. Since light generated from the left inner side filament 46 is concentrated on the left inner side reflection plate 47, it is possible to emit directional heat ray to the vehicle body 11. Similarly to the left inner heater 36, the left outer heater 38, the right inner heater 43 and the right outer heater 45 are respectively with a reflection plate to surround a filament.

Further, since specific heat capacity of the near-infrared lamp is smaller compared to a far-infrared lamp, the near-infrared lamp has a faster response speed. If the response speed is faster, a rapid power control for a command from the control part becomes possible. Since a stand-by time to the heating can be shortened, this contributes to the shortening of the drying time.

In addition, the drying furnace 20 is provided with a control part 48. The control part 48 controls the left inner heater 36, the left outer heater 38, the right inner heater 43 and the right outer heater 45. The control part 48 sends a power command to the near-infrared lamp based on the temperature information from the upstream temperature measuring part (reference numeral 27 in FIG. 5) and the downstream temperature measuring part (reference numeral 29 in FIG. 5). That is, the power of the near-infrared lamp can be controlled by the control part 48. Next, a detailed configuration of the upstream temperature measuring part is described with reference to FIG. 7.

Figure 7:
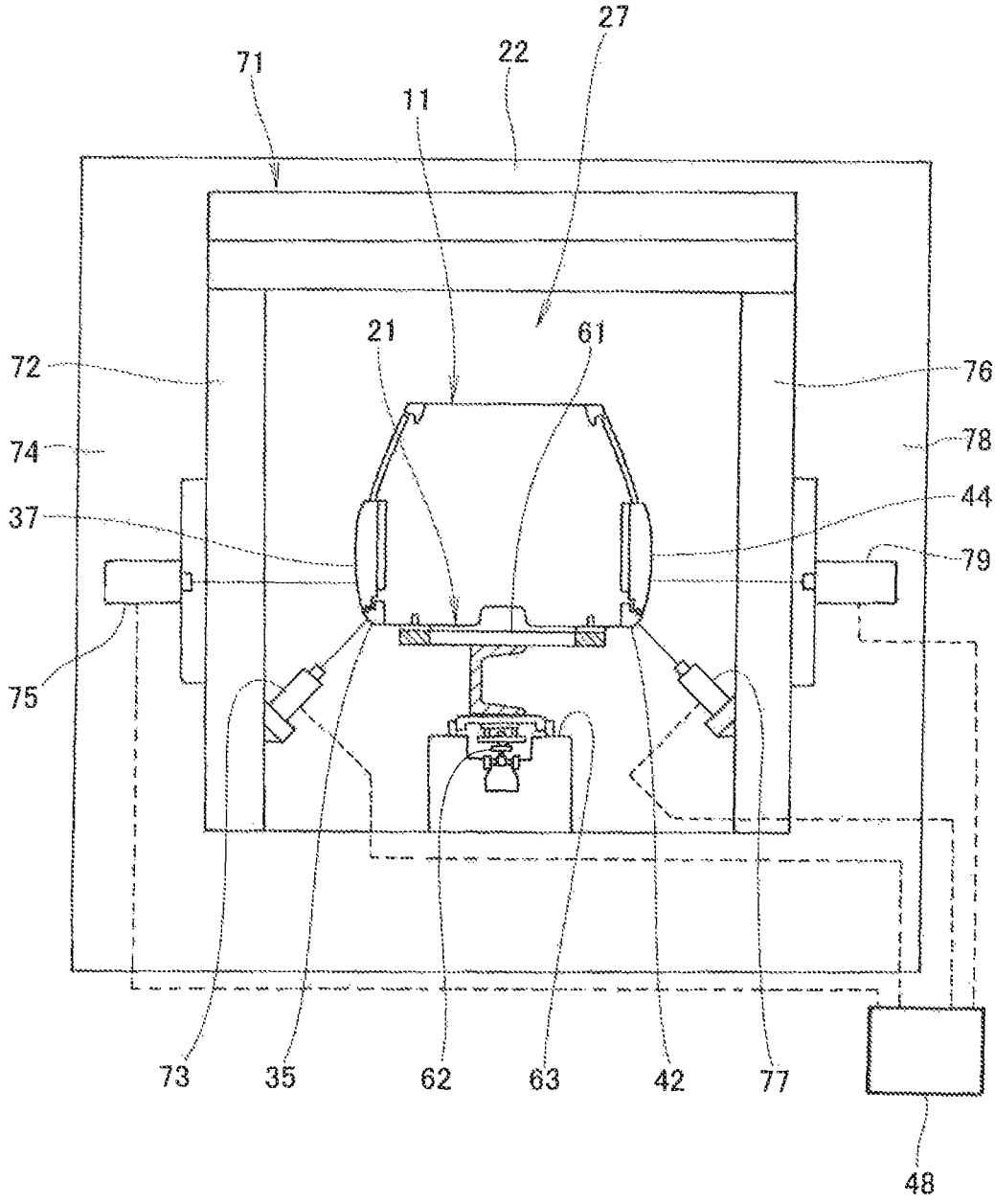
FIG. 7 is a cross-sectional view taken along line 7-7 of FIG. 5.

As shown in FIG. 7, the upstream temperature measuring part 27 includes a first left upstream temperature measuring part 73 provided on a left column 72 of a portal frame 71, a second left upstream temperature measuring part 75 provided on a left furnace wall 74, a first right upstream temperature measuring part 77 provided on a right column 76 of the portal frame 71 and a second right upstream temperature measuring part 79 provided on a right furnace wall 78. The first left upstream temperature measuring part 73 measures the temperature of the left side sill 35. The second left upstream temperature measuring part 75 measures the temperature of the left door outer panel 37. The first right upstream temperature measuring part 77 measures the temperature of the right side sill 42. The second right upstream temperature measuring part 79 measures the temperature of the right door outer panel 44.

The first left upstream temperature measuring part 73, the second left upstream temperature measuring part 75, the first right upstream temperature measuring part 77 and the second right upstream temperature measuring part 79 are respectively a non-contact sensor. These sensors detect thermal radiation which is emitted from the vehicle body 11 heated by the hot air and calculate the temperature of the side sill and the outer door panel of the vehicle body 11.

In addition, the first left upstream temperature measuring part 73, the second left upstream temperature measuring part 75, the first right upstream temperature measuring part 77 and the second right upstream temperature measuring part 79 are connected to the control part 48. The control part 48 sends a power command to the left inner heater (reference numeral 36 in FIG. 6) and the left outer heater (reference numeral 38 in FIG. 6) based on the temperature information from the first left upstream temperature measuring part 73 and the second left upstream temperature measuring part 75. For example, when the temperature of the left side sill 35 measured by the first left upstream temperature measuring part 73 is lower than the temperature of the left door outer panel 37 measured by the second left upstream temperature measuring part 75, the control part sends a high-power command to the left inner heater and the left outer heater.

In the upstream temperature measuring part 27, when the temperature of the left side sill 35 measured by the first left upstream temperature measuring part 73 is largely different from the temperature of the left door outer panel 37 measured by the second left upstream temperature measuring part 75, a high-power command is sent to the left inner heater (reference numeral 36 in FIG. 6) and the left outer heater (reference numeral 38 in FIG. 6) from the control part 48. On the contrary, when the temperature of the left side sill 35 measured by the first left upstream temperature measuring part 73 is slightly different from the temperature of the left door outer panel 37 measured by the second left upstream temperature measuring part 75, a low-power command is sent to the left inner heater and the left outer heater from the control part 48.

By comparing the temperature of the side sill of the vehicle body with the temperature of the door outer panel in this way, the control part 48 controls the left inner heater and the left outer heater to output a suitable amount of heat in accordance with the temperature difference. Accordingly, the left inner heater and the left outer heater can apply the suitable amount of heat to the side sill.

Further, the control part 48 sends a power command to the right inner heater (reference numeral 43 in FIG. 6) and the right outer heater (reference numeral 45 in FIG. 6) based on the temperature information from the first right upstream temperature measuring part 77 and the second right upstream temperature measuring part 79. Next, a detailed configuration of the downstream temperature measuring part is described with reference to FIG. 8.

Figure 8:
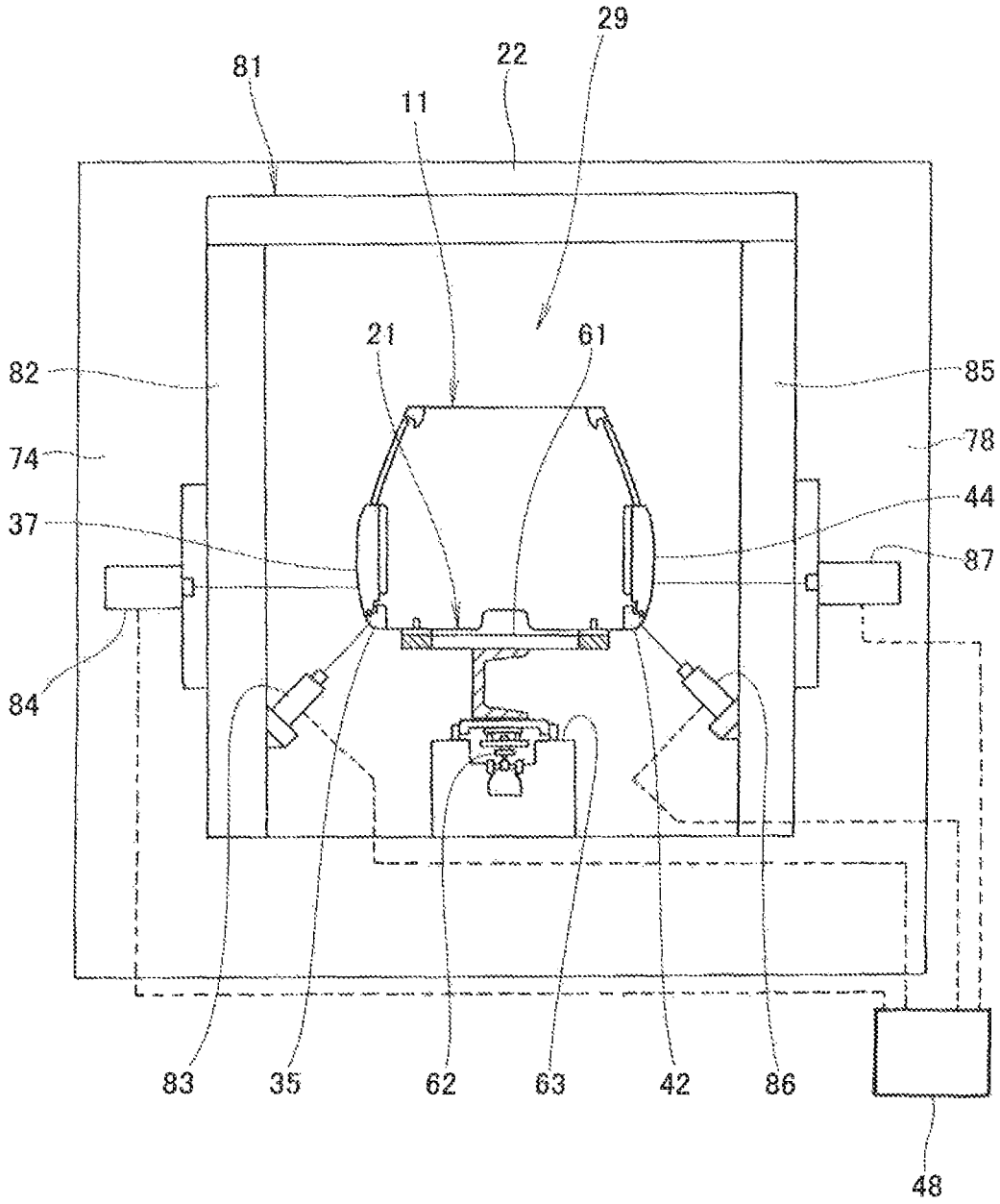
FIG. 8 is a cross-sectional view taken along line 8-8 of FIG. 5.

As shown in FIG. 8, the downstream temperature measuring part 29 includes a first left downstream temperature measuring part 83 provided on a left column 82 of a portal frame 81, a second left downstream temperature measuring part 84 provided on the left furnace wall 74, a first right downstream temperature measuring part 86 provided on a right column 85 of the portal frame 81 and a second right downstream temperature measuring part 87 provided on the right furnace wall 78. The first left downstream temperature measuring part 83 measures the temperature of the left side sill 35. The second left downstream temperature measuring part 84 measures the temperature of the left door outer panel 37. The first right downstream temperature measuring part 86 measures the temperature of the right side sill 42. The second right downstream temperature measuring part 87 measures the temperature of the right door outer panel 44.

The first left downstream temperature measuring part 83, the second left downstream temperature measuring part 84, the first right downstream temperature measuring part 86 and the second right downstream temperature measuring part 87 are respectively a non-contact sensor. These sensors detect thermal radiation which is emitted from the vehicle body 11 heated by the hot air and calculate the temperature of the side sill and the outer door panel of the vehicle body 11.

The first left downstream temperature measuring part 83, the second left downstream temperature measuring part 84, the first right downstream temperature measuring part 86 and the second right downstream temperature measuring part 87 are connected to the control part 48. The control part 48 sends a power command to the left inner heater (reference numeral 36 in FIG. 6) and the left outer heater (reference numeral 38 in FIG. 6) based on the temperature information from the first left downstream temperature measuring part 83 and the second left downstream temperature measuring part 84. For example, when the temperature of the left side sill 35 measured by the first left downstream temperature measuring part 83 is higher than the temperature of the left door outer panel 37 measured by the second left downstream temperature measuring part 84, the control part sends a low-power command to the left inner heater and the left outer heater.

Further, the control part 48 sends a power command to the right inner heater (reference numeral 43 in FIG. 6) and the right outer heater (reference numeral 45 in FIG. 6) based on the temperature information from the first right downstream temperature measuring part 86 and the second right downstream temperature measuring part 87.

Next, an operation of the above-described drying furnace is described.

Figure 9A:
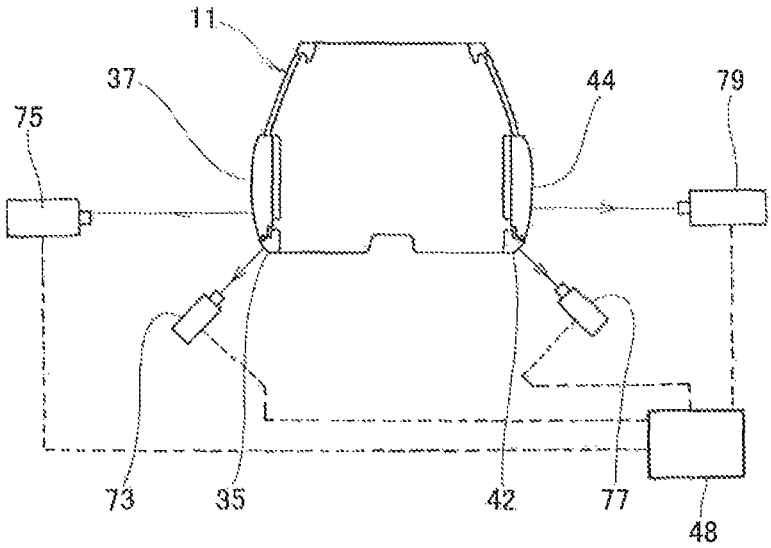
FIGS. 9(*a*) to 9(*c*) are views for explaining an operation of a temperature measuring part and a heater.
Figure 9B:
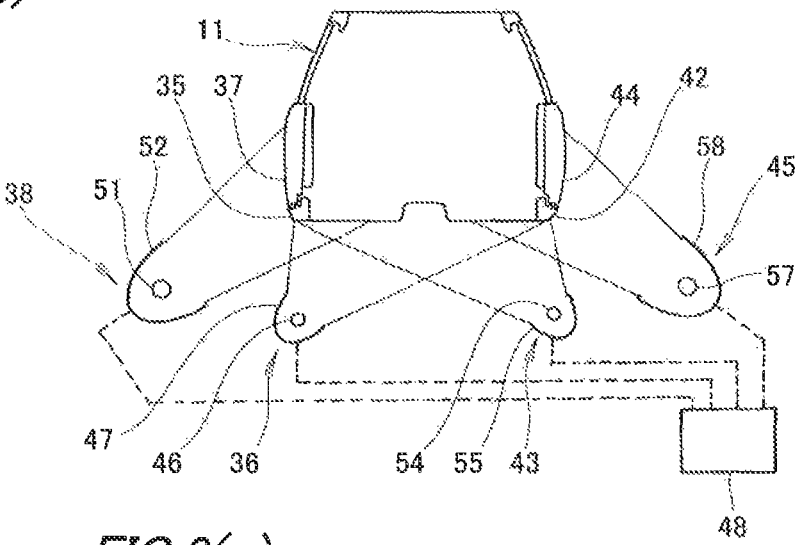
Figure 9C:
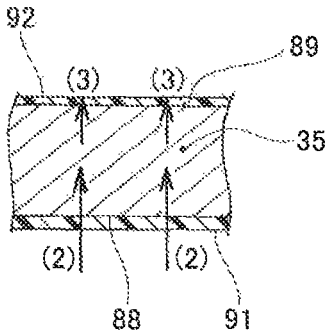

As shown in FIG. 9 (*a*), in the upstream temperature measuring part (reference numeral 27 in FIG. 7), the first left upstream temperature measuring part 73 measures the temperature of the left side sill 35, the second left upstream temperature measuring part 75 measures the temperature of the left door outer panel 37, the first right upstream temperature measuring part 77 measures the temperature of the right side sill 42 and the second right upstream temperature measuring part 79 measures the temperature of the right door outer panel 44.

Measurement results are assumed that the temperature of the left side sill 35 is lower than the temperature of the left door outer panel 37 and the temperature of the right side sill 42 is lower than the temperature of the right door outer panel 44.

As shown in FIG. 9 (*b*), the control part 48 sends a high-power command to the left inner heater 36, the left outer heater 38, the right inner heater 43 and the right outer heater 45 based on the measurement results. In accordance with the high-power command, the left inner heater 36, the left outer heater 38, the right inner heater 43 and the right outer heater 45 intensively irradiate the left side sill 35 and the right side sill 42 with near-infrared ray. Since the left side sill 35 and the right side sill 42 are irradiated, it is possible to eliminate the temperature difference between the left side sill and the left door outer panel 37 and between the right side sill 42 and the right door outer panel 44. That is, it is possible to evenly increase the temperature of each part of the vehicle body 11.

In the drying furnace (reference numeral 20 in FIG. 4), the left side sill 35 and the right side sill 42 are locally heated by the left inner heater 36, the left outer heater 38, the right inner heater 43 and the right outer heater 45 in a state where the vehicle body 11 is entirely heated by the hot air. Since the radiant heat applied by the left inner heater 36, the left outer heater 38, the right inner heater 43 and the right outer heater 45 is absorbed by the left side sill 35 and the right side sill 42 in the form of electromagnetic waves, the left side sill 35 and the right side sill 42 can be reliably heated.

As shown in FIG. 3 (*b*), since the temperature of the side sill is increased during the time Ta by such a local heating, it is possible to reliably heat the side sill to a temperature approximate to that of the outer door panel.

In FIG. 9 (*b*), if the left side sill 35 and the right side sill 42 are locally heated by the hot air ejected from the ejection nozzle in a state where the vehicle body 11 is entirely heated by the hot air, the ejected hot air is spread around the left side sill 35 and the right side sill 42. With such a spread of the hot air, it is difficult to allow the hot air to evenly reach the left side sill 35 and the right side sill 42 and therefore it is difficult to increase the temperature of the left side sill 35 and the right side sill 42. Heating may be continuously performed in order to increase the temperature of the left side sill and the right side sill 42. However, in this case, the left door outer panel 37 and the right door outer panel 44 which have been already heated are subjected to excessive heat.

In this regard, the drying furnace (reference numeral 20 in FIG. 4) according to the above-described embodiment can reliably heat the left side sill 35 and the right side sill 42 to a temperature approximate to that of the left door outer panel 37 and the right door outer panel 44 by applying the radiant heat to the left side sill 35 and the right side sill 42 of the vehicle body 11. That is, since the temperature of the left side sill 35 and the right side sill 42 and the temperature of the left door outer panel 37 and the right door outer panel 44 can be substantially equally increased, there is no case that the left door outer panel 37 and the right door outer panel 44 are subjected to the excessive heat. Accordingly, it is possible to provide the drying furnace capable of reducing unnecessary amount of heat which was given to the door outer panel.

In the above-described embodiment, the near-infrared ray is used to locally heat the vehicle body 11. As shown in the above-described Table 1, the far-infrared ray has the absorption rate of approximately 74% relative to the acrylic water-based paint but does not give an effect to the coating film which is applied to an inner surface of the vehicle body. On the contrary, the near-infrared ray has the absorption rate of approximately 35% relative to iron. Since the above-described embodiment uses the near-infrared ray as heat source of the local heating, the iron, that is, the vehicle body is mainly heated and the coating film on the inner surface is dried by the heat from the vehicle body.

Specifically, the near-infrared ray is irradiated on an outer coating film 91 of the left side sill 35, as shown in FIG. 9 (*c*). When the near-infrared ray irradiated is absorbed to the left side sill 35 as indicated by arrow (2), the left side sill 35 is heated. Since the heat of the left side sill 35 is transmitted toward an inner surface 89 of the left side sill 35, an inner coating film 92 of the left side sill 35 is dried. The inner surface 89 of the left side sill 35 is a region which is not directly irradiated with the near-infrared ray. That is, by using the near-infrared ray, even the temperature of the region of the left side sill 35 which is not directly irradiated with the near-infrared ray can be increased using the heat conduction of the left side sill 35 without time-consumption.

Next, the drying method using the drying furnace is described.

Figure 10:
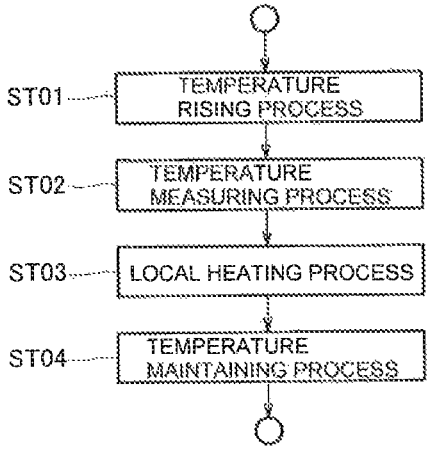
FIG. 10 is a flowchart of the drying method.
Figure 11:
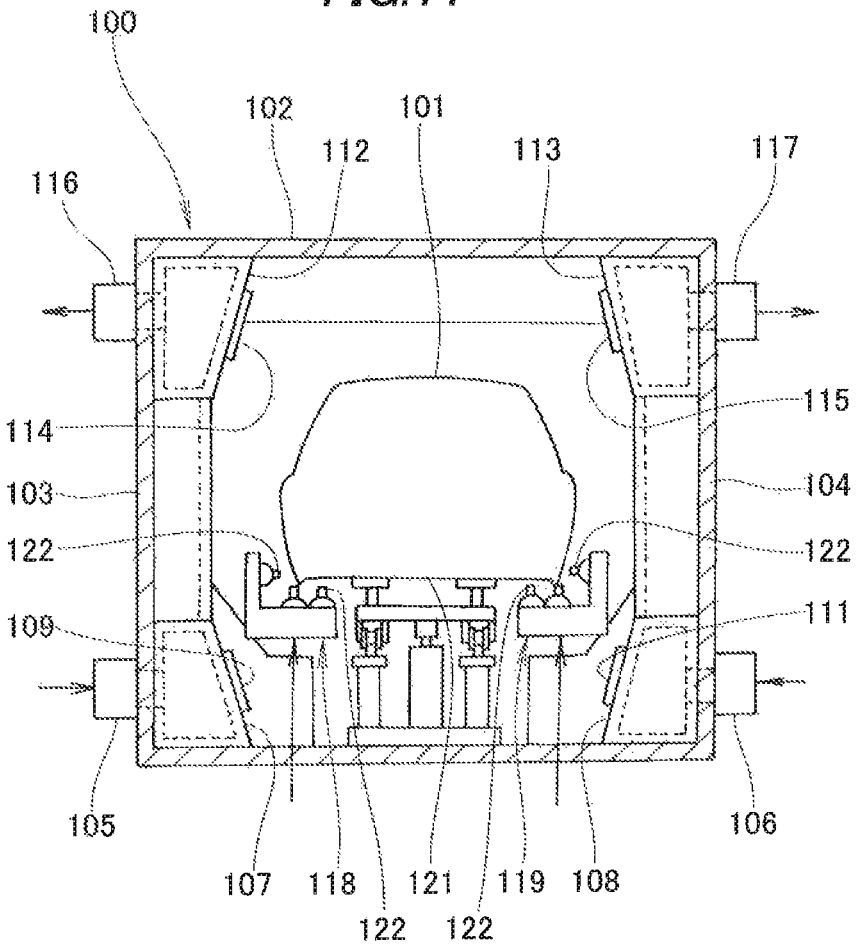
FIG. 11 is a view for explaining a basic configuration of the related art.

As shown in FIG. 10, in step (hereinafter referred to as "ST") 01, the temperature of the object is increased. Specifically, the temperature of the vehicle body 11 is increased by the first hot air heating part 23, as shown in FIG. 4.

In ST02, the temperature of the hard-heating region of the object which has a larger heat capacity than the other regions is measured by a first temperature measuring part and the temperature of the other regions is measure by a second temperature measuring part. Specifically, in the upstream temperature measuring part 27, the temperature of the left side sill 35 is measured by the first left upstream temperature measuring part 73, the temperature of the left door outer panel 37 is measured by the second left upstream temperature measuring part 75, the temperature of the right side sill 42 is measured by the first right upstream temperature measuring part 77, and the temperature of the right door outer panel 44 is measured by the second right upstream temperature measuring part 79, as shown in FIG. 9 (*a*).

In ST03, the radiant heat is applied to the hard-heating region of the object and thus the hard-heating region is heated to a temperature approximate to that of the other region. Specifically, the left inner heater 36, the left outer heater 38, the right inner heater 43 and the right outer heater 45 intensively irradiate the left side sill 35 and the right side sill 42 with the near-infrared ray, as shown in FIG. 9 (*b*).

In ST04, the temperature of the object is constantly maintained. Specifically, the increased temperature of the vehicle body 11 is maintained by the second hot air heating part 24, as shown in FIG. 4.

The drying method is carried out using the drying furnace 20 which dries the vehicle body 11 by the hot air. Further, the drying method includes a temperature increasing process for increasing the temperature of the vehicle body 11, a temperature measuring process for measuring the temperature of the left side sill 35 by the first left upstream temperature measuring part 73 and measuring the temperature of the left door outer panel 37 by the second left upstream temperature measuring part 75 (see FIG. 9 (*a*)), a local heating process for locally heating the left side sill 35 to a temperature approximate to that of the left door outer panel 37 by applying radiant heat to the left side sill 35 (see FIG. 9 (*b*)) and a temperature maintaining process for constantly maintaining the temperature of the vehicle body 11 (see FIG. 4).

In FIG. 9 (*b*), since the radiant heat used in the local heating process is absorbed by the vehicle body 11 in the form of electromagnetic waves, the left side sill can be reliably heated. In FIG. 3, since the temperature of the side sill is increased by locally heating the side sill during the time Ta, it is possible to reliably heat the side sill to a temperature approximate to that of the door outer panel.

In FIG. 9 (*b*), if the left side sill 35 is locally heated by the hot air ejected from the ejection nozzle in a state where the vehicle body 11 is entirely heated by the hot air, the ejected hot air is spread around the left side sill 35. With such a spread of the hot air, it is difficult to allow the hot air to evenly reach the left side sill 35 and therefore it is difficult to increase the temperature of the left side sill 35. Heating may be continuously performed in order to increase the temperature of the left side sill 35. However, in this case, the left door outer panel 37 which has been already heated is subjected to excessive heat.

In this regard, the drying method of the present invention can reliably heat the left side sill 35 to a temperature approximate to that of the left door outer panel 37 by applying the radiant heat to the left side sill 35 in the local heating process. That is, since the temperature of the side sill and the temperature of the door outer panel can be substantially equally increased, there is no case that the door outer panel is subjected to the excessive heat. Accordingly, it is possible to provide the drying method capable of reducing unnecessary amount of heat which was given to the door outer panel.

In addition, the vehicle body 11 is subjected to a painting operation before being introduced into the drying furnace (reference numeral 20 in FIG. 4). Further, the timing for applying the radiant heat to the side sill in the local heating process (see FIG. 2 (*b*)) is the timing when the temperature of the side sill measured by the first temperature measuring part reaches the cross-linking temperature of the paint applied onto the vehicle body.

If the painted vehicle body is put into the drying furnace and then the radiant heat is applied to the side sill of the vehicle body at the start of the hot air drying (see FIG. 2 (*a*)), the paint applied on the side sill is fluidized. However, since the side sill is locally heated by the radiant heat and thus the temperature rising speed of the side sill becomes larger, the paint in an insufficient flowing state becomes hot and thus the paint is hardened. Accordingly, the coating film is difficult to be smooth and thus the quality of the coating film is degraded.

In this regard, the drying method according to the above-described embodiment applies the radiant heat to the side sill at timing when the temperature of the side sill of the vehicle body reaches the cross-linking temperature of the paint applied onto the side sill, as shown in FIG. 2 (*b*). That is, the side sill is subjected to the local heating by the radiant heat when a predetermined time has elapsed from the start of the hot air drying. During from the start of the hot air drying to the start of the local heating, the paint applied onto the side sill is fluidized. At the start of the hot air drying, the temperature rising speed of the side sill is small. Therefore, after the paint is sufficiently flowing, the paint becomes hot and then is hardened. As a result, the smooth coating film can be achieved and thus the quality of the coating film is improved.

Further, since the above-described embodiment uses the near-infrared ray as heat source of the radiant heat, the iron, that is, the vehicle body is mainly heated and the coating film on the inner surface can be dried by the heat from the vehicle body.

Meanwhile, although the painted vehicle body has been represented as an example of the object in the above-described embodiment, the present invention may be applied to machines or structures which have been subjected to a painting operation.

Further, although the side sill of the vehicle body has been represented as an example of "the hard-heating region which has a larger heat capacity than the other regions" in the above-described embodiment, "the hard-heating region which has a larger heat capacity than the other regions" may be other thick portion of the vehicle body.

Further, although the door outer panel has been represented as an example of "the other regions" in the above-described embodiment, "the other regions" may be other thin portion of the vehicle body such as a hood outer panel or a lid outer panel.

REFERENCE NUMERALS

11 . . . object (vehicle body), 20 . . . drying furnace, 35 . . . hard-heating region (left side sill), 36 . . . heater (left inner heater), 37 . . . the other region (left door outer panel), 38 . . . heater (left outer heater), 42 . . . hard-heating region (right side sill), 43 . . . heater (right inner heater), 44 . . . the other region (right door outer panel), 45 . . . heater (right outer heater), 48 . . . control part, 73 . . . first temperature measuring part (first left upstream temperature measuring part), 75 . . . second temperature measuring part (second left upstream temperature measuring part), 77 . . . first temperature measuring part (first right upstream temperature measuring part), 79 . . . second temperature measuring part (second right upstream temperature measuring part)

The invention claimed is:

1. A drying furnace in which an object subjected to a painting operation before being introduced into the drying furnace is dried by hot air, the drying furnace comprising:

a heater that applies radiant heat to a hard-heating region having a larger heat capacity than another region in the object so as to heat the hard-heating region to a temperature approximate to a temperature of the other region, wherein the heater applies the radiant heat at a timing when the temperature of the hard-heating region measured by a first temperature measuring part reaches a cross-linking temperature of a paint applied onto the object during the painting operation.

2. The drying furnace according to claim 1, wherein the heater comprises a near-infrared lamp.

3. The drying furnace according to claim 1, further comprising:

a first temperature measuring part that measures the temperature of the hard-heating region and a second temperature measuring part that measures the temperature of the other regions, the first temperature measuring part and the second temperature measuring part being provided on an upstream side of the heater; and a control part that controls a power of the heater based on temperature information from the first temperature measuring part and the second temperature measuring part.

4. A drying method for drying an object by hot air using a drying furnace, the drying method comprising:

a temperature increasing process of increasing a temperature of the object;

a temperature measuring process of measuring a temperature of a hard-heating region having a larger heat capacity than another region in the object by a first temperature measuring part and measuring a temperature of the other region by a second temperature measuring part;

a local heating process of locally heating the hard-heating region to a temperature approximate to the temperature of the other region by applying radiant heat to the hard-heating region of the object; and a temperature maintaining process of constantly maintaining the temperature of the object, wherein the object is subjected to a painting operation before being introduced into the drying furnace, wherein a timing for applying the radiant heat to the hard-heating region of the object in the local heating process is a timing when the temperature of the hard-heating region measured by the first temperature measuring part reaches a cross-linking temperature of a paint applied onto the object, and wherein the local heating by the radiant heat is applied at the timing when the temperature of the hard-heating region reaches the cross-linking temperature so that a temperature rising speed becomes larger.

5. The drying method according to claim 4, wherein the object is a vehicle body, wherein a heat source of the radiant heat is a near-infrared ray, and wherein a temperature of the object applied on a portion which is not directly irradiated by the near-infrared ray is increased with heat conduction from the vehicle body.

* * * * *